US009297238B2

(12) United States Patent
Scantlebury et al.

(10) Patent No.: US 9,297,238 B2
(45) Date of Patent: Mar. 29, 2016

(54) METHOD AND APPARATUS FOR CONTROL OF A PLUNGER LIFT SYSTEM

(71) Applicant: Extreme Telematics Corp., Calgary (CA)

(72) Inventors: Mark David Scantlebury, Calgary (CA); Clint Edward Mason, Carstairs (CA)

(73) Assignee: Extreme Telematics Corp., Alberta (CA)

( * ) Notice: Subject to any disclaimer, the term of this patent is extended or adjusted under 35 U.S.C. 154(b) by 395 days.

(21) Appl. No.: 13/933,578

(22) Filed: Jul. 2, 2013

(65) Prior Publication Data

US 2014/0158349 A1 Jun. 12, 2014

(30) Foreign Application Priority Data

Dec. 11, 2012 (CA) ..... 2798389

(51) Int. Cl.
*E21B 43/12* (2006.01)
*E21B 47/00* (2012.01)
*E21B 44/00* (2006.01)

(52) U.S. Cl.
CPC ..... *E21B 43/121* (2013.01); *E21B 44/00* (2013.01); *E21B 47/0007* (2013.01)

(58) Field of Classification Search
CPC .... E21B 43/121; E21B 47/0007; E21B 47/09
See application file for complete search history.

(56) References Cited

U.S. PATENT DOCUMENTS 4,291,761 A 9/1981 Watson
5,146,991 A 9/1992 Rogers, Jr.
5,878,817 A 3/1999 Stastka
5,984,013 A * 11/1999 Giacomino ..... E21B 43/121 166/373
6,241,014 B1 * 6/2001 Majek ..... E21B 43/121 166/372
6,536,522 B2 3/2003 Birckhead et al.
6,595,287 B2 7/2003 Fisher
6,883,606 B2 4/2005 Evans et al.
7,219,725 B2 5/2007 Chisholm
7,490,675 B2 2/2009 Hearn
7,597,143 B2 10/2009 Giacomino
7,690,425 B2 4/2010 Giacomino
7,748,450 B2 7/2010 Mundell
7,806,188 B2 10/2010 Hearn
7,819,189 B1 10/2010 Cosby
7,950,464 B2 5/2011 Atencio et al.
7,963,326 B2 6/2011 Giacomino
2007/0261845 A1 * 11/2007 White ..... E21B 43/121 166/250.15
2008/0202746 A1 * 8/2008 Mudry ..... E21B 43/121 166/250.15

(Continued)

FOREIGN PATENT DOCUMENTS

JP 2003099886 A 4/2003

*Primary Examiner* — Robert E Fuller
(74) *Attorney, Agent, or Firm* — Craig J. Lervick; Larkin Hoffman Daly & Lingren, Ltd.

(57) ABSTRACT

A method and apparatus for operating a plunger lift system in a well can include: opening a control valve and allowing a plunger to rise to a top of the well; determining an actual rise time of the plunger based on a time it take the plunger to rise to the top of the well; using actual rise time of the plunger and a target rise time calculating adjustments to the afterflow time or close time; and allowing the afterflow time to pass before closing the control valve and keeping the valve closed for the close time. The methods are repeated, each time calculating a new adjusted afterflow time or adjusted close time to incrementally alter these times.

21 Claims, 5 Drawing Sheets

(56) References Cited

U.S. PATENT DOCUMENTS

2010/0310384 A1 12/2010 Stephenson et al.
2012/0318524 A1* 12/2012 Lea, Jr. ..... E21B 47/0007 166/372
2012/0323493 A1 12/2012 Wright et al.
2013/0071262 A1* 3/2013 Green ..... E21B 43/122 417/65
2014/0231079 A1* 8/2014 Scantlebury ..... E21B 47/00 166/255.1

* cited by examiner

METHOD AND APPARATUS FOR CONTROL OF A PLUNGER LIFT SYSTEM

The invention relates to the control of oil and gas wells using a plunger lift device and more particularly to methods for adjusting the close times and afterflow times used by a plunger lift system

BACKGROUND

A plunger lift is an artificial lift method that is used to remove fluids from a gas well. A plunger lift system uses a freely moving plunger in the production tubing where the plunger forms a seal with the production tubing to prevent fluid from passing between the plunger and the wall of the production tubing. The plunger starts at the bottom of the well and when there is sufficient pressure behind the plunger, the plunger can be forced by this pressure to the top of the well. Fluid that has accumulated above the plunger is pushed ahead of the plunger where it is removed from the well.

The movement of the plunger is controlled by opening and closing a valve between the production tubing and an outlet line (commonly called a sales line). When the valve is closed, the plunger can drop to the bottom of the well. With the valve closed, the pressure from the well builds up and when a desired pressure level is reached, the valve can be opened connecting the production tubing with the outlet line. Because the outlet line is typically of a lower pressure than the elevated pressure in the production tubing, the gas with its elevated pressure exits through the open valve and into the outlet line. This causes the plunger to rise in the production well and up into the well head. This plunger can then be held in the well head until the gas exiting the production well through the open valve is sufficiently reduced and the plunger can then fall back down the production tubing.

Plunger lift systems can be used to produce either gas from a well or oil (or some other saleable liquid). When the plunger lift system is used to produce gas from the well, the plunger is used to remove water that has entered the well. The plunger is held at the top of the well to allow gas to flow out of the well and into the outlet line. Periodically, the plunger is dropped to the bottom of the well and then allowed to rise up the well again to carry water up and out of the well. When the plunger lift system is used to produce oil from the well, the plunger is used to produce the oil from the well and the gas is simply used to lift the plunger up the well. The plunger is allowed to fall to the bottom of the well and oil to flow into the well above the plunger. When the valve is opened and the plunger is allowed to rise up the well, the plunger will carry the oil that has accumulated on top of the plunger up to the top of the well where it can be removed.

The times used by the plunger system when the valve is opened and when the valve is closed are very important to the operation of the plunger lift system. While these times can be initially set based on an educated guess, it is very hard for a person to determine just what these times should be for a specific well and the conditions in any given well can vary from what an experienced well operator was expecting. After the initial times are determined and set, these times often need fine tuning and changing during the operation of the well in order to optimize them for a particular well. Additionally, the conditions of a well can vary over time, causing times that might have worked well with the plunger lift system at one time to not work as well over the entire time the plunger lift system is operating.

SUMMARY

In an aspect, a method of operating a plunger lift system in a gas producing well is provided. The method includes: opening a control valve and allowing a plunger to rise to a top of the well; determining an actual rise time of the plunger based on a time it takes the plunger to rise to the top of the well; using the current afterflow time and a difference between a target rise time and the actual rise time to calculate an adjusted afterflow time; allowing the adjusted afterflow time to pass before closing the control valve and keeping the valve closed for a close time; and, repeating the steps of the method, each time calculating a new adjusted afterflow time and keeping the control valve open for the new adjusted afterflow time.

In another aspect, a controller for controlling the operation of a plunger lift system for a gas producing well having a plunger, a plunger arrival sensor and a valve between the well and an outlet line is provided. The controller can include: at least one processing unit; an input interface operatively connectable to the plunger arrival sensor; an output interface operatively connectable to the valve and operative to open and close the valve; and at least one memory containing program instructions. The at least one processing unit can be responsive to the program instructions and operative to perform a method comprising: opening the valve and allowing the plunger to rise to a top of the well; in response to receiving a signal from the plunger arrival sensor, closing the valve and determining an actual rise time of the plunger based on a time it takes the plunger to rise to the top of the well; using a current afterflow time and a difference between a target rise time and the actual rise time to calculate an adjusted afterflow time; after the adjusted afterflow time has passed, closing the valve and keeping the valve closed for a close time; and repeating the steps of the method, each time calculating a new adjusted afterflow time and keeping the control valve open for the new adjusted afterflow time.

In another aspect, a method of operating a plunger lift system in a fluid producing well is provided. The method includes: opening a control valve and allowing a plunger to rise to a top of the well; determining an actual rise time of the plunger based on a time it take the plunger to rise to the top of the well; using the current close time and a difference between a target rise time and the actual rise time to calculate an adjusted close time; allowing the a period of time to pass before closing the control valve and keeping the valve closed for the adjusted close time; and repeating the steps of the method, each time calculating a new adjusted close time and using the new adjusted close time in the method.

In another aspect, a controller for controlling the operation of a plunger lift system for a fluid producing well having a plunger, a plunger arrival sensor and a valve between the well and an outlet line is provided. The controller can include: at least one processing unit; an input interface operatively connectable to the plunger arrival sensor; an output interface operatively connectable to the valve and operative to open a close the valve; at least one memory containing program instructions. The at least one processing unit can be responsive to the program instructions and operative to perform a method comprising: opening the valve and allowing the plunger to rise to a top of the well; in response to receiving a signal from the plunger arrival sensor, closing the valve and determining an actual rise time of the plunger based on a time it take the plunger to rise to the top of the well; using the current close time and a difference between a target rise time and the actual rise time to calculate an adjusted close time; after a period of time has passed, closing the valve and keeping the valve closed for the adjusted close time; and repeating the steps of the method, each time calculating a new adjusted close time and using the new adjusted close time.

In another aspect, a method of operating a plunger lift system in a gas producing well is provided. The method comprises: opening a control valve and allowing a plunger to rise to a top of the well; determining an actual rise time of the plunger based on a time it take the plunger to rise to the top of the well; using a current close time and a difference between a target rise time and the actual rise time to calculate an adjusted close time; allowing a current afterflow time to pass before closing the control valve and keeping the valve closed for the adjusted close time; while the adjusted close time is greater than a minimum limit and less than a maximum limit, repeating the steps of the method, each time calculating a new adjusted close time and using the new adjusted close time in the method; and after the adjusted close time reaches one of the minimum limit and the maximum limit, using the current afterflow time and a difference between a target rise time and the actual rise time to calculate an adjusted afterflow time; allowing the adjusted afterflow time to pass before closing the control valve and keeping the valve closed for the adjusted close time; opening a control valve and allowing a plunger to rise to a top of the well; determining an actual rise time of the plunger based on a time it take the plunger to rise to the top of the well; and repeating steps of the method, each time calculating a new adjusted afterflow time and using the new adjusted afterflow.

DESCRIPTION OF THE DRAWINGS

A preferred embodiment is described below with reference to the accompanying drawings, in which.

DETAILED DESCRIPTION OF THE ILLUSTRATED EMBODIMENTS

Figure 1:
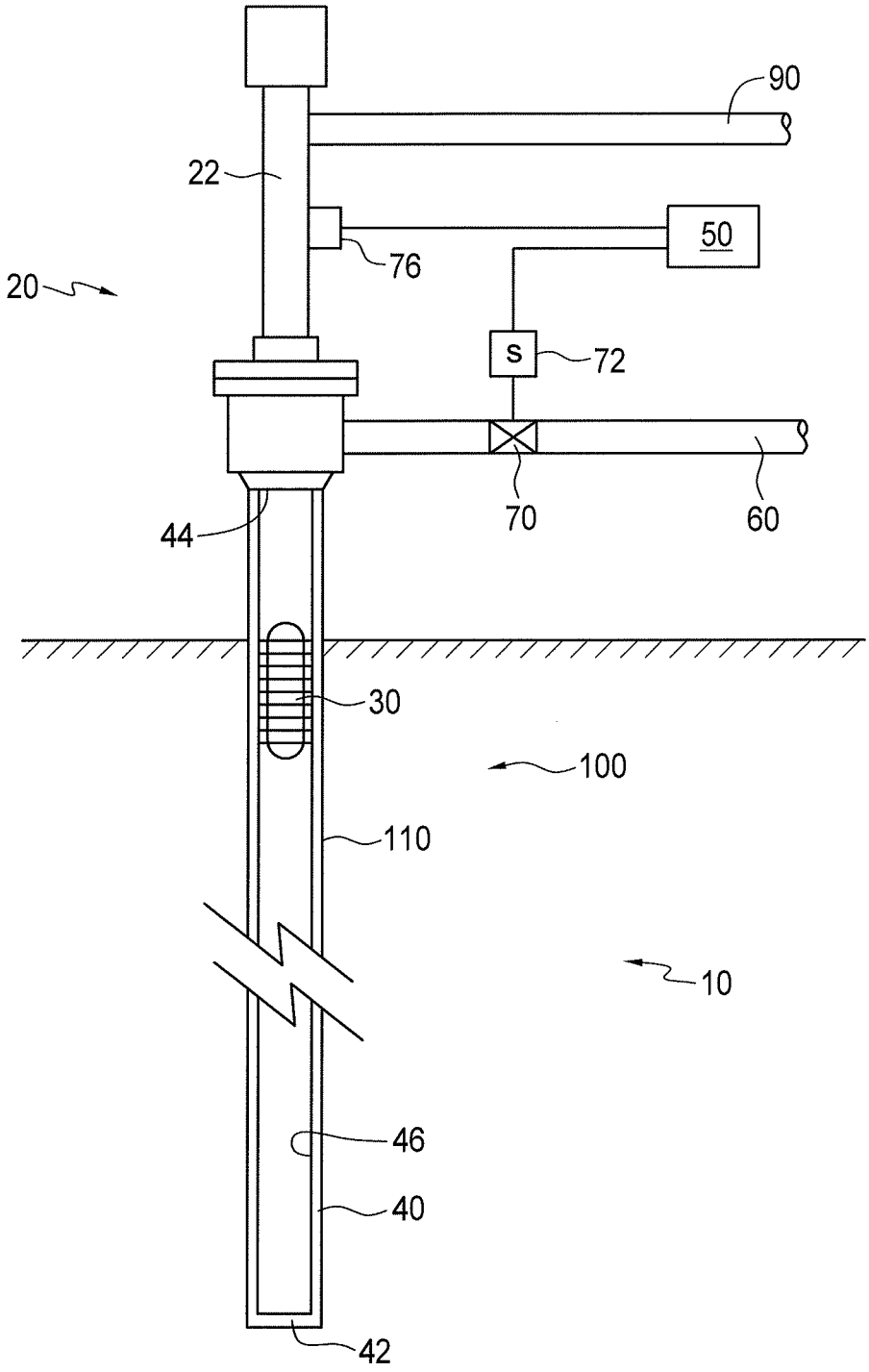
FIG. 1 illustrates a schematic illustration of a plunger lift system.

FIG. 1 illustrates a plunger lift system 10 for removing fluids from a well 100. The plunger lift system 10 can include: a wellhead 20: a plunger 30; production tubing 40; a controller 50; an outlet line 60; a control valve 70; a plunger arrival sensor 76; a discharge line 90; and other equipment for the operation of the plunger lift system 10.

The well 100 is typically provided with well casing 110. Production tubing 40 can be provided running down the well casing 110 between the wellhead 100 and the bottom 42 of the production tubing 40.

The plunger 30 can be provided in production tubing 40 so that the plunger 30 is able to move up and down in the production tubing 40. The plunger 30 can form a seal with the wall 46 of the production tubing 40 to prevent significant amounts of fluids from passing around the plunger 30 between the outside of the plunger 30 and the wall 46 of the production tubing 40.

The wellhead 20 can be provided at a top of the well casing 110 and the production tubing 40. The wellhead 20 can fluidly connect the production tubing 40 and the well casing 110 to the outlet line 60. The outlet line 60 routes gas out of the well 10 for transport or collection. A control valve 70 can be provided between the sales line 60 and the well 100.

The wellhead 20 can include a plunger receiver 22 operatively connected to a top end 44 of the production tubing 40 and above where the outlet line 60 is connected. At the top of its travel, the plunger 30 can enter the plunger receiver 22 and be held in place in the plunger receiver 22 entirely above where the outlet line 60 connects with the well 10. A plunger arrival sensor 76 can be provided in conjunction with the plunger receiver 22 to determine when the plunger 30 has reached the top of the production tubing 40 and entered the plunger receiver 22.

A discharge line 90 can be connected to the plunger receiver 22 so that fluids pushed into the plunger receiver 22 by the plunger 30 can be removed from the plunger receiver 22. In some cases, these fluids may be routed through a separator (not shown) so that unwanted liquids and other contaminants can be removed from plunger receiver 22. If the plunger lift system 10 is being used to produce oil (or other saleable liquids) from the well 100, the oil is discharged out of the plunger lift system 10 through this discharge line 90.

Figure 2:
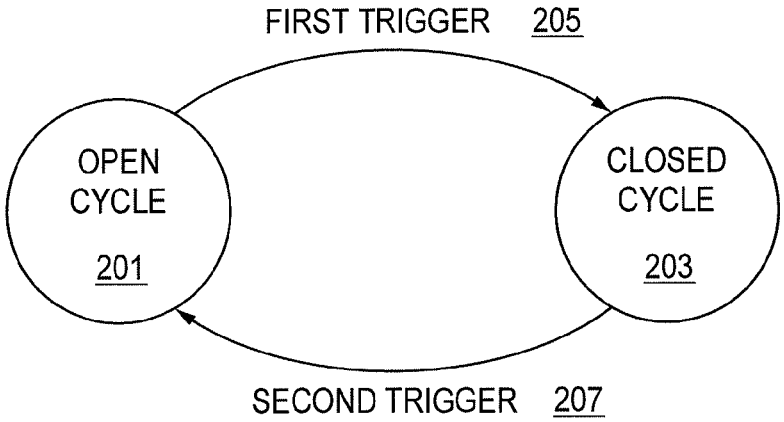
FIG. 2 illustrates a state diagram illustrating the different modes of operation of the plunger lift system of FIG. 1.

Referring to FIG. 2, the plunger lift system 10 alternates between an open cycle 201 (or production cycle) where the control valve 70 is opened and gas is flowing out of the well 100 through the outlet line 60 and a closed cycle 203 (or shut in cycle) where the control valve 70 is closed and gas is prevented from flowing out of the well 100 into the outlet line 60 allowing the pressure in the well 100 to increase. A first trigger 205 will cause the plunger lift system 10 to change from operation in the open cycle 201 to the closed cycle 203 and a second trigger 207 will cause it to move from the closed cycle 203 to the open cycle 201. Typically, this first trigger 205 is the closing of the valve 70 and the second trigger 207 is an opening of the valve 70.

During the closed cycle 203, when the control valve 70 is closed and gas cannot flow out of the well 100 to the outlet line 60, the plunger 30 can drop down the well 100 to a position proximate the bottom of the well 100. When the closed cycle 203 is finished and the control valve 70 is opened, pressure that has built up in the well 100 causes the plunger 30 to rise up the production tubing 40 to the wellhead 20 and into the plunger receiver 22. Once the plunger 30 is in place in the plunger receiver 22, the control valve 70 can remain open and gas can be produced from the well 100 by allowing it to flow into the outlet line 60. Any fluid brought up the well 100 above the plunger 30 can be discharged out the discharge line 90. The time the control valve 70 is opened is the open cycle 201.

Once the open cycle ends 201 and the control valve 70 is closed, the plunger 30 can be released by the plunger receiver 22 and the weight of the plunger 30 can cause it to drop back down the production tubing 40 to the bottom of the well 100. As the closed cycle 203 continues and the control valve 70 remains closed, the pressure in the well 100 can increase. When the pressure has increased to a sufficient level, the control valve 70 can once again be opened and the open cycle 201 can begin and the plunger 30 can begin to rise to the top of the well 100.

When the plunger lift system 10 is used to produce gas from the well 100, it is desirable to maximize the time the plunger lift system 10 remains in the open cycle 201 so that as much time as possible is spent producing gas from the well 100 during this open cycle 201 but not have the open cycle 201 occur for so long that the well 100 waters in and well 100 stops flowing gas because the weight of water in the well 100 and the plunger 30 is too great for the pressure of the gas below the plunger 30 to lift the plunger 30 up the well 100.

When the plunger lift system 10 is used to produce oil from the well 100, it is desirable to adjust the time the plunger lift system 10 remains in the closed cycle 203, allowing the plunger 30 to make as many trips as possible up the well 100, bringing up as much oil as it can carry, but not have the time set so long that too much oil is allowed to accumulate on top of the plunger 30 causing the oil and the plunger 30 to weigh so much that the pressure of the gas below the plunger 30 cannot lift the plunger 30 and the accumulated oil on top of the plunger 30 up the well 100.

Figure 3:
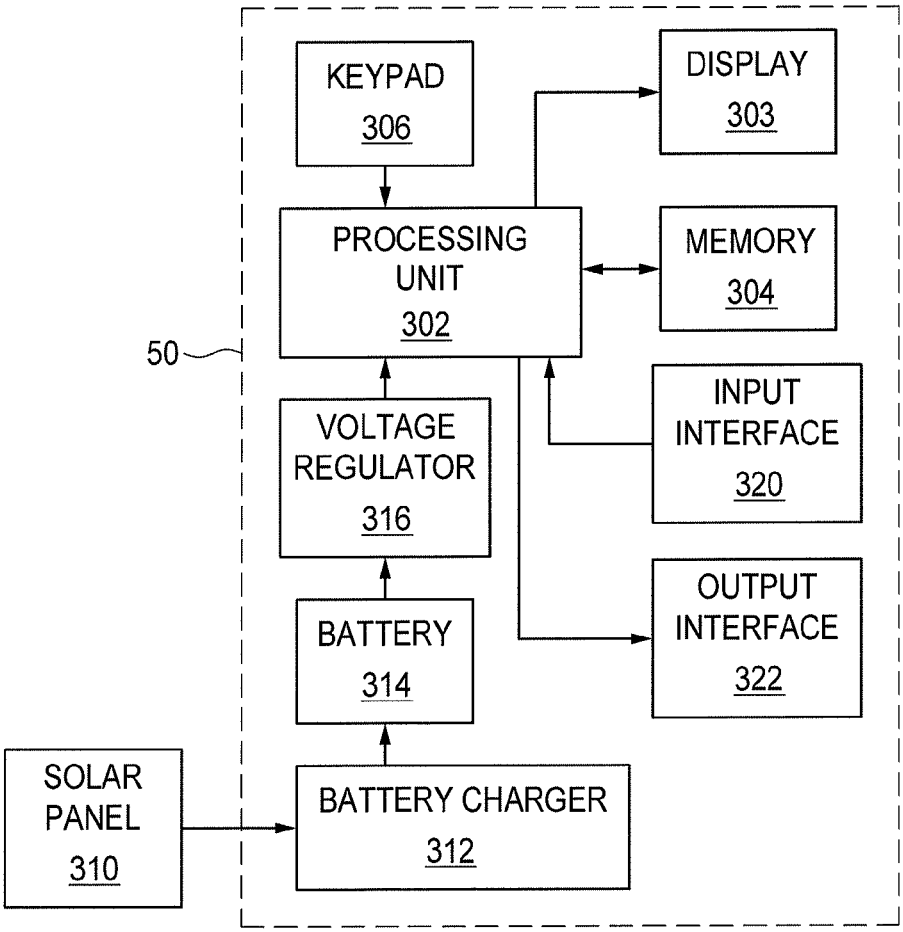
FIG. 3 illustrates a schematic illustration of a controller for use in the plunger lift system of FIG. 1.

FIG. 3 illustrates a controller 50 that can be used to control the operation of the plunger lift system 100 and alter the operation of the plunger lift system 100 between the open cycle and the closed cycle. Referring again to FIG. 1, the controller 50 can be operably connected to the solenoid 72 so that by sending signals to the solenoid 72 the controller 50 can cause the opening and closing of the control valve 70. The controller 50 can also be operatively connected to the plunger arrival sensor 76 so that the controller 50 can receive a signal from the plunger arrival sensor 76 when the plunger 30 reaches the top of the well 100 and enters the plunger receiver 22.

The controller 50 can include a processing unit 302, such a microprocessor that is operatively connected to a computer readable memory 304 and can control the operation of the controller 50. Program instructions for controlling the operation of the processing unit 302 can be stored in the memory 304 as well as any additional data needed for the operation of the controller 50. A keypad 306 and a display 303 can be provided to allow a user to see the settings of the controller 50 and enter inputs and change parameters of the controller 50. An input interface 320 can be provided operatively connected to the processing unit 302 so that the controller 50 can receive signals from external sensors. The plunger arrival sensor 76 can be connected to the input interface 320 to allow signals from the plunger arrival sensor 76 to be transmitted to the controller 50. An output interface 322 can be provided operatively connected to the processing unit 302 to send signals to other devices in the plunger lift system 10. For example, the solenoid 72 attached to the control valve 70 can be connected to the output interface 322 so that the controller 50 can send signals to the solenoid 72.

Because the controller 50 is frequently in remote locations and because the well 100 the controller 50 is being used with is typically located in remote regions, the controller 50 can be connected to a solar panel 310 that supplies power to controller 50. A battery 314 can be provided to power the processing unit 302 and the battery can be charged with a battery charger 312 connected to the solar panel 310. A voltage regulator 316 can be provided between the processing unit 302 and the battery 314 to provide the proper voltage to the processing unit 302.

The controller 50 can include a weatherproof enclosure 350 for protecting the components of the controller 50 from the elements.

When the plunger lift system 10 is used to produce gas from the well 100, ideally the length of the afterflow is maximized without this afterflow time being so long that the well 100 will water in during this afterflow time. At the same time, the close time can be minimized, simply providing enough time for the plunger 30 to reach the bottom of the well 100 and collect the water that has collected there before the valve 70 is once again opened and the plunger 30 is used to carry the water to the top of the well 100 and gas is once more being produced from the well 100.

Figure 4:
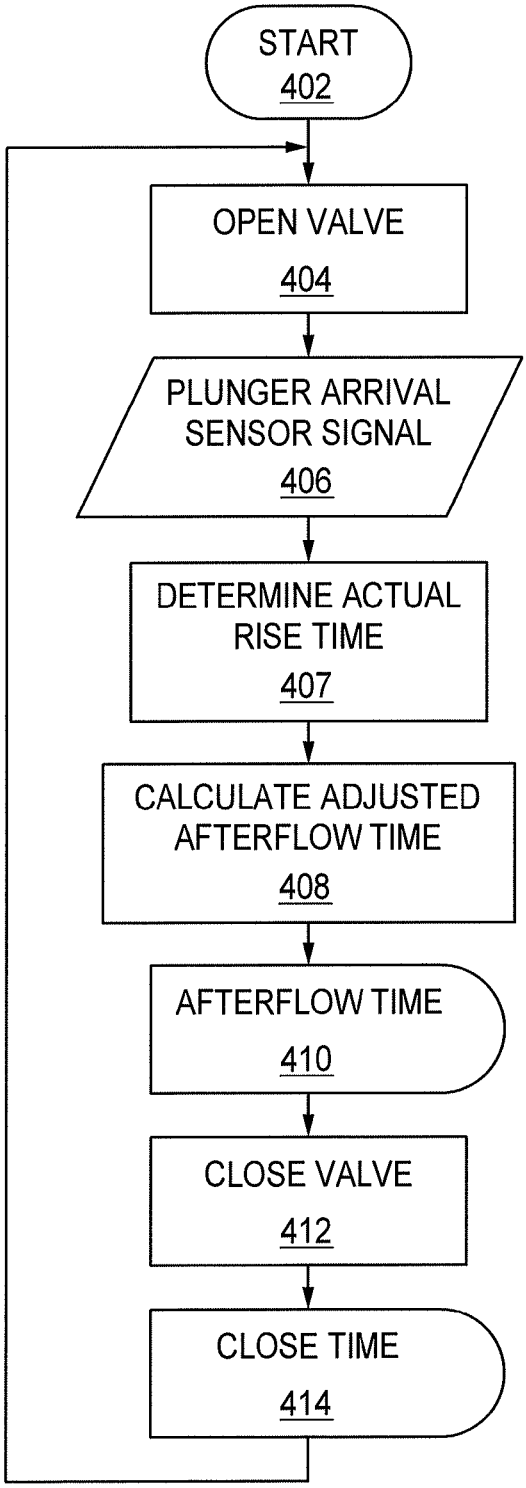
FIG. 4 illustrates a flowchart of a method for optimizing the afterflow time.

FIG. 4 illustrates a flow chart for adjusting the afterflow time of the plunger lift system 10 when the plunger lift system 10 is used to produce gas from the well 100. Before the plunger lift system 10 is used, a user can set an initial afterflow time, a close time and a target rise time. The initial afterflow time will be the time the controller 50 allows the control valve 70 to remain open after the plunger 30 has reached the plunger receiver 22 and a signal has been sent to the controller 50 from the plunger arrival sensor 76. This initial after flow time will be based on the specific conditions of the well 100, but typically will be a conservative estimate and likely be a relatively short amount of time.

The target rise time is an "ideal" time it takes the plunger 30 to travel up the production tubing 40 from the bottom 42 of the well 100 and reach the plunger receiver 22 after the control valve 60 has been opened. In one aspect, this target rise time can be based on a desired "ideal" velocity of the plunger 30 travelling up the production tubing 40 and the depth of the well 100. This ideal velocity is usually based on setting a speed of the plunger 30 low enough so that when it enters the plunger receiver 22 it is travelling slow enough not to cause damage to the well head 20. In some aspects this ideal velocity could be 250 m/min. With an operator entering this ideal velocity and the depth of well 100 the plunger lift system 10 is being used with, the target rise time can then be determined by the controller 50.

After the initial afterflow time, close time and target rise time have been set in the controller 50, the plunger lift system 10 can be started at step 402 and the method can begin. When the controller 50 opens the control valve 70 at step 404, the plunger 30 can begin to travel up the production tubing 40 to the top of the well 100 and the well head 20. The control valve 70 can be left opened at step 404 until the plunger 30 reaches the plunger receiver 22 and the controller 50 receives a signal from the plunger arrival sensor 76 at step 406.

Once the controller 50 has received a signal from the plunger arrival sensor 76, the controller 50 can determine the actual rise time of the plunger 30 at step 407. The actual rise time can be determined by taking the time from when the controller 50 opened the control valve 70 at step 404 to the time the plunger 30 arrives in the plunger receiver 22 and the controller 50 received a signal from the plunger arrival sensor 76 at step 406. The actual rise time of the plunger 30 is used because it is an indicator of how much fluid is being carried up to the surface by the plunger 30. If the actual rise time is less than the target rise time, this means the plunger is traveling slower than its target velocity, suggesting too much water has collected in the well 100 and its weight is slowing the plunger 30 down and therefore the afterflow time can be decreased to reduce the amount of water collecting in the well 100 during the afterflow time. Conversely, if the actual rise time is less than the target rise time, this means that more water can be allowed to accumulate in the well 100 because the plunger 30 is traveling faster than the ideal velocity and therefore the afterflow time can be increased to allow more water to accumulate in the well 100 between cycles.

With the actual rise time determined at step 407, the method can move onto step 408 and calculate an adjustment for the initial afterflow time as follows:

$$\Delta AfterflowTime = \frac{TargetRise - ActualRise}{TargetRise} \times ScalingFactor \times AfterflowTime \quad (1)$$

where ΔAfterflowTime is the change to be made to the afterflow time, TargetRise is the target rise time or ideal time of the plunger 30 to rise from the bottom of the production tubing 40 to the top of the well 100, ActualRise is the time measured by the controller 50 for the plunger 30 to arrive at the plunger receiver 22 determined at step 407, ScalingFactor is a range between 0 and 1 that allows an operator to set how aggressive a change is to be made to afterflow time and the AfterflowTime is the current afterflow time set in the controller 50 (initially this will be the initial afterflow time). The controller 50 can then vary the initial afterflow time by the determined change to be made to the afterflow time to arrive at an adjusted afterflow time as follows:

$$\text{AdjustedAfterflowTime}=\text{CurrentAfterflowrime}=\Delta\text{AfterflowTime} \quad (2)$$

With the adjusted afterflow time determined at step 408, the controller 50 can move on to step 410 and keep the control valve 70 open for this adjusted afterflow time.

At the end of the adjusted afterflow time, the controller 50 moves to step 412 and sends a signal to the solenoid 72 to close the control valve 70, shutting the well 100 in, and the plunger 30 can be released from the plunger receiver 22, causing the plunger 30 to drop back down the well 100 to a position proximate the bottom 42 of the well 100.

At step 414, the controller 50 can leave the control valve 70 closed for the close time to allow the plunger 30 to fall to the bottom of the well 100 and collect the water that has formed in the well 100 on top of the plunger 30. Because the purpose of the method is to produce as much gas from the well 100 as possible, the close time can be set to a minimum value. In one aspect, it can be set to be just enough time for the plunger 30 to drop to the bottom of the well 100. In a further aspect, a plunger drop velocity of 55 m/min can be used in conjunction with the depth of the well 100 to determine a close time consisting of the time for the plunger 30 to drop down the depth of the well 100 and reach the bottom.

After the close time, the controller 50 can return to step 404 and once again send a signal to open the control valve 404 and wait for a signal from the plunger arrival sensor 76 to move onto step 406. The method will keep repeating with the controller 50 repeatedly determining each actual rise time of the plunger 30 at step 407 and then using this newly determined actual rise time to calculate a change to the afterflow time and an adjusted afterflow time at step 408. The adjusted afterflow time is then used at step 410 as the afterflow time for the plunger lift system 10 before the controller 50 once again closes the valve 70 at step 412 and leaves it closed for the close time at step 414. With each repetition of steps of the method, the afterflow time is adjusted, either longer or shorter, using equations (1) and (2) depending on the actual rise time of the plunger 30. In this manner, as the plunger lift system 10 cycles between open cycles, where gas is being produced from the well 100, and closed cycles, where the well 100 is shut in, the controller 50 can use equations (1) and (2) to repeatedly adjust the afterflow time to try and get the plunger 30 to rise at the target rise time.

This method allows the afterflow time to be repeatedly adjusted as gas continues to be produced from the well 100. Because the change made to the afterflow time is a function of the current afterflow time, it also limits the amount that the afterflow time can be adjusted; with only small changes being made when the afterflow period is relatively small, but then allowing greater changes when the afterflow time is longer. In this manner, the adjustments are made in a manner to prevent the changes from adversely affecting the well 100 and can make large adjustments to the afterflow time over a long period of time without needing an operator to go back to the controller 50 and readjust any of the settings.

In addition to the method simply adjusting the afterflow time so that the plunger 30 will travel up the well 100 at a target rise time, the method can take into account changing conditions in the well 100 itself. As the plunger lift system 10 is in use producing gas from the well 100, the conditions in the well 100 can change over time. For example, as the plunger lift system 10 removes water from the well 100, less and less water may seep into the well 100 as more and more water is removed from the well, allowing the afterflow time to be increased more and more over time. The method and equations (1) and (2) allow the automatic adjustment of the afterflow to take the changing conditions in the well 100 in adjusting the afterflow time over time, allowing the afterflow time to be increased more and more as less and less water is flowing into the well 100 during the open cycle.

The method and equations (1) and (2) also limit the amount the afterflow can be adjusted to prevent too large of an adjustment to affect the operation of the plunger lift system 10. Initially, a well 100 may only be able to flow for a relatively small amount of time and an initial afterflow time can be set that is very small. However, with this small initial afterflow time, the well 100 may only be able to tolerate relatively small changes to the afterflow time. If the afterflow time is adjusted by too much too quickly it can cause the well 100 to water in forcing a crew to come in and clean out the well 100 before it can begin producing gas again. The current method limits the change in the afterflow time to a relatively small change (further limited by the scaling factor that is chosen) when the current afterflow time is relatively small by making the change to the afterflow time a function of the current afterflow time. However, after the plunger lift system 100 has been operating for a while and less water is entering the well 100 during the open cycle and the afterflow time has become relatively large (in some cases they can flow for 100 hours or more), the well 100 can tolerate much larger changes to the afterflow time and the use of the adjustment in equation (1) allows greater changes to the afterflow time to be made when the afterflow time is already a relatively long time.

Additionally, the scaling factor allows an operator to make the adjustments even smaller and more incremental, by allowing the operator to specify a number greater than 0 up to 1, with 1 allowing the greatest adjustment (signifying a change between 0 and 100%). This allows the changes to the afterflow time to be made even more incrementally if desired by the operator.

Over the course of time, the afterflow time approaches the optimum time without any intervention from the operator using incremental adjustments that can increase in size as the afterflow increases and automatically compensates for the common situation where less water is flowing into the well during the afterflow time.

When the plunger lift system 10 is used to produce oil or other saleable fluids from the well 100, the close time can be maximized to allow the greatest amount of fluid to be carried up the well 100 that the gas pressure in the well 100 will allow. At the same time, the afterflow time can be minimized since the gas being produced from the well 100 is not the main consideration.

Figure 5:
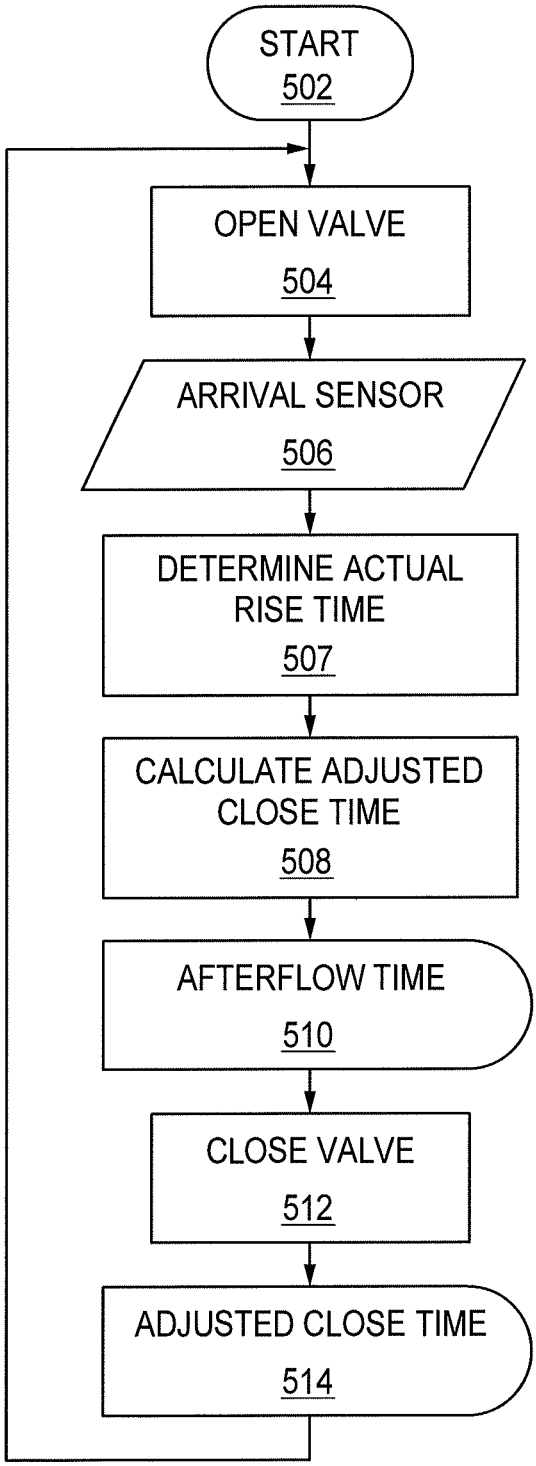
FIG. 5 illustrates a flowchart of a method for optimizing the close time.

FIG. 5 illustrates a flow chart for optimizing the close time of the plunger lift system 10 when the plunger lift system 10 is used to produce oil or some other saleable fluid from the well 100. Before the plunger lift system 10 is used, a user can set an initial close time, an afterflow time and a target rise time. The initial close time will be the time the controller 50 allows the control valve 70 to remain closed and fluid to collect above the plunger 30. This initial close time will be based on the conditions of the well 100, but typically will be a relatively short period of time because an operator will want to set a conservative close time that can be altered by the controller 50 while the plunger lift system 10 is in operation.

Similar to the method for optimizing the rise time, the target rise time is the ideal time it takes the plunger 30 to travel up the production tubing 40 from the bottom 42 of the well 100 and reach the plunger receiver 22 after the control valve 60 has been opened. Again, this can be based on a desired "ideal" velocity, such as 250 m/min, of the plunger 30 travelling up the production tubing 40 and the depth of the well 100.

After the initial close time, afterflow time and target rise time have been set in the controller 50, the plunger lift system 10 can be started at step 502 and the method can begin. When the controller 50 opens the control valve 70 at step 504, the plunger 30 can begin to travel up the production tubing 40 to the top of the well 100 and the well head 20 until the plunger 30 reaches the plunger receiver 22 and the controller 50 receives a signal from the plunger arrival sensor 76 at step 506. Once the controller 50 has received a signal from the plunger arrival sensor 76, the controller 50 can determine the actual rise time of the plunger 30 at step 507. The actual rise time can be determined by determining the time from when the controller 50 opened the control valve 70 at step 504 to the time the plunger 30 arrives in the plunger receiver 22 and the controller 50 received a signal from the plunger arrival sensor 76 at step 506.

Like the rise time determined for the adjustment of the afterflow time, the rise time of the plunger 30 is an indicator of how much fluid is being carried up the well by the plunger 30. If the actual rise time is less than the target rise time it likely indicates that too much pressure is being allowed to build up and therefore the close time should be decreased. Conversely, if the actual rise time is longer than the target rise time, it means not enough pressure has been allowed to build up and the close time can be increased.

With the actual rise time determined at step 507, the method can move onto step 508 and calculate an adjustment for the initial close time using the actual rise time as follows:

$$\Delta CloseTime = \frac{TargetRise - ActualRise}{TargetRise} \times ScalingFactor \times CloseTime \quad (3)$$

where ΔCloseTime is the change to be made to the close time, TargetRise is the target rise time or ideal time of the plunger 30 to rise from the bottom of the production tubing 40 to the top of the well 100, ActualRise is the time measured by the controller 50 for the plunger 30 to rise to the top of the well 100, ScalingFactor is a range between 0-1 that allows an operator to set how aggressive a change is to be made to close time and the Close Time is the current close time set in the controller 50 (initially this will be the initial close time). The controller 50 can then apply this change in time to the close time currently being used by the controller 50 to result in an adjusted close time as follows:

$$AdjustedCloseTime = CurrentCloseTime - \Delta CloseTime \quad (4)$$

With the adjusted close time determined at step 508, the controller 50 can move on to step 510 and keep the control valve 70 open for the afterflow time.

At the end of the afterflow time at step 510, the controller 50 can move to step 512 and send a signal to the solenoid 72 to close the control valve 70, shutting the well 100 in, and the plunger 30 can be released from the plunger receiver 22, causing the plunger 30 to drop back down the well 100 to a position proximate the bottom 42 of the well 100.

The controller 50 can leave the control valve 70 closed for the adjusted closed time calculated at step 508, allowing it to collect oil or other fluid above it and the pressure to build up below it. After the close time, the controller 50 can move to step 404 and once again send a signal to open the control valve 404 and wait for a signal from the plunger arrival sensor 76.

The method will keep repeating with the controller 50 repeatedly determining each actual rise time of the plunger 30 at step 507 and then using this newly determined actual rise time to calculate a change to the close time and an adjusted close time at step 508. The adjusted close time is then used at step 512 as the close time for the plunger lift system 10. In this manner, the close time can be repeatedly adjusted during the operation of the plunger lift system 10 using equations (3) and (4) changing the operation of the system to try and achieve an ideal rise time of the plunger 30 in the well 100 to increase the production of oil or other desirable liquid from the well. Over the course of time, this method will allow the plunger lift system 10 to optimize the close time without any intervention from the operator.

Like the method for adjusting the afterflow time, this method allows the close time to be repeatedly adjusted as the well 100 continues to operate. Because the change made to the close time is a function of the current close time, it also limits the amount that the close time can be adjusted. In this manner, the adjustments are made in a manner to prevent the changes from adversely affecting the well 100.

Additionally, the scaling factor allows an operator to make the adjustments even smaller and more incremental, by allowing the operator to specify a number greater than 0 up to 1, with 1 allowing the greatest adjustment (signifying a change between 0 and 100%). This allows the changes to the close time to be made even more incrementally if desired by the operator.

Figure 6:
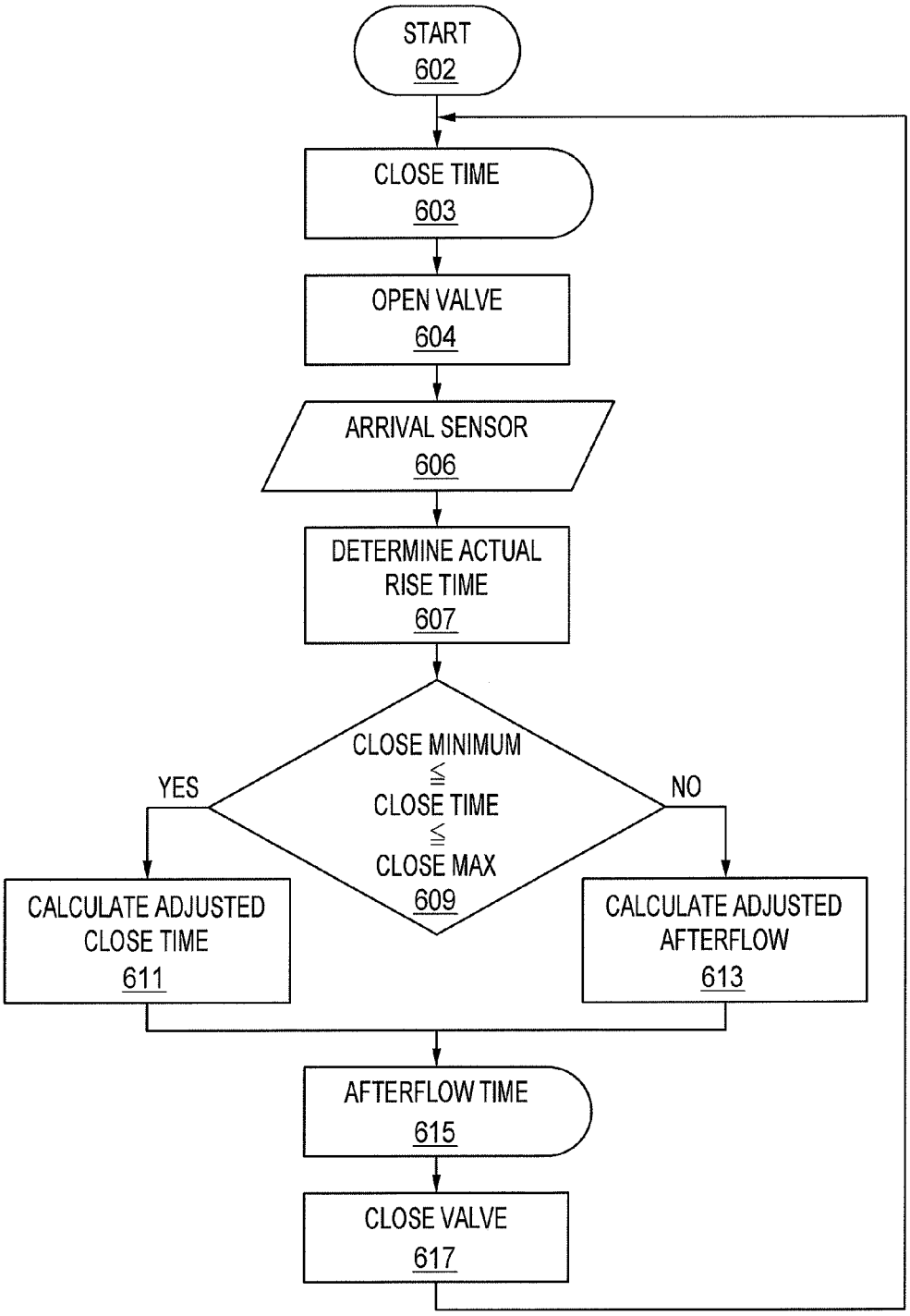
FIG. 6 illustrates a flowchart of a method for first optimizing a close time of the well followed by optimizing the afterflow time.

Referring to FIG. 6, illustrates a flowchart for a method of first adjusting the close time and then adjusting the afterflow time when the plunger lift system 10 is being used to produce gas from the well 100. The method first adjusts the close time to remove fluids (such as water, etc.) from the well 100. Once the close time has been adjusted so that it reaches either a minimum or maximum close time limit, the method then adjusts the afterflow time to try and optimize gas production from the well 100. Before the method starts at 602, a user can set an initial close time, an initial afterflow time and a target rise time. The method will also require the controller 50 to have limits for the close time in the form of a minimum close time and a maximum close time. These minimum close time and maximum close time values can either be preset in the controller 50 or the controller 50 can allow a user to enter these limits.

After the initial afterflow time, initial close time and target rise time have been set in the controller 50, the plunger lift system 10 can be started at step 602 and the method can begin. The controller 50 can first keep the control valve 70 closed for the initial close time at step 603 to let pressure build behind the plunger 30 before opening the control valve 70 at step 604. After step 604, the plunger 30 will begin to travel up the production tubing 40 to the top of the well 100 and the well head 20. The control valve 70 can be left opened at step 604 until the plunger 30 reaches the plunger receiver 22 and the controller 50 receives a signal from the plunger arrival sensor 76 at step 606.

At step 607, the controller 50 can determine the actual rise time of the plunger 30 based on the time it has taken the plunger 30 to reach the top of the well head 20. The controller 50 can then move to step 609 where the controller 50 can determine whether the current close time falls within the close time minimum or close time maximum set for the controller 50. If the current close time falls within these two values this means that the close time can still be adjusted and the controller 50 can move onto step 611 and calculate an adjusted close time using equations (3) and (4). This adjusted close time will then be used in place of the previous close time the next time the controller 50 moves to step 603. However, if at step 609 the controller 50 determines that the current close time has reached either the maximum close time or the minimum close time set by the controller 50, this means that the close time has been adjusted as much as it can be. The controller 50 can then move onto step 613 and determine an adjusted afterflow time using equations (1) and (2).

After either step 611 or step 613 is performed by the controller, determining a new adjusted close time or new adjusted afterflow time, respectively. The controller 50 can move on to step 615 and wait for the current afterflow time before moving onto step 617 and closing the valve 70. After step 617, the method controller can once more move to step 603 and wait the current close time at step 603 before once again performing steps 604, 606, 607, determining which step to take at 609 and then adjusting either the close time or the afterflow time as determined in step 609 before once again waiting for the afterflow time at step 615 and then closing the valve at step 617.

Because of the steps of the method and the use of step 609 to determine whether the close time has reached one of its limits, the method shown in FIG. 6 first adjusts the close time until the close time reaches either the minimum close time limit or the maximum close time limit set in the controller 50. Each time the method is repeated, the controller 50 can incrementally adjust the close time to try and optimize it and take into account changing amounts of fluid entering the well 100 between plunger 30 trips. Ideally, if the close time has been adjusted as the method is repeated so that the close time is less than or equal to the minimum close time limit, this typically means that water (or other fluids) have been removed from the well 100 and that water is not entering the well 100 at as fast a rate between plunger trips allowing the close time to set to as low a time as practical. However, if the close time is adjusted over time so that it is equal to or greater than the maximum close time limit, this typically means that the close time should not be adjusted any further and the afterflow time should be adjusted. Once the close time has been adjusted to either its minimum limit or its maximum limit, the next time the method is repeated and reaches step 609, the controller 50 will then start performing step 613 and start incrementally adjusting the afterflow time in order to try and optimize the afterflow time.

The method shown in FIG. 6 will result in first the close time being adjusted to remove fluid from the well and then after the close time has been adjusted to either the minimum or maximum limit, adjusting the afterflow time is incrementally adjusted each time the method is repeated to try and optimize the production of gas from the well 100.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

The invention claimed is:

1. A method of operating a plunger lift system in a gas producing well, the method comprising:

opening a control valve and allowing a plunger to rise to a top of the well;

determining an actual rise time of the plunger based on a time it takes the plunger to rise to the top of the well;

using a current afterflow time and a difference between a target rise time and the actual rise time to calculate an adjusted afterflow time;

allowing the adjusted afterflow time to pass before closing the control valve and keeping the valve closed for a close time;

and repeating the steps of the method, each time calculating a new adjusted afterflow time and keeping the control valve open for the new adjusted afterflow time, wherein the adjusted afterflow time is calculated using the function:

$$\Delta AfterflowTime = \frac{TargetRise - ActualRise}{TargetRise} \times ScalingFactor \times AfterflowTime$$

and $$AdjustedAfterflowTime = CurrentAfterflowTime + \Delta AfterflowTime$$

and wherein,

ΔAfterflowTime is the change to be made to the afterflow time,

TargetRise is the target rise time of the plunger to the top of the well,

ActualRise is the time measured for the plunger to reach the top of the well,

ScalingFactor is a range between 0-1, and

AfterflowTime is the current afterflow time.

2. The method of claim 1 wherein the change made to the current afterflow time to calculate the adjusted afterflow time is a function of the current afterflow time.

3. The method of claim 2 wherein the greater the current afterflow time, the greater the difference between the current afterflow time and the adjusted afterflow time.

4. The method of claim 1 wherein the Scaling Factor is less than 1.

5. A controller for controlling the operation of a plunger lift system for a gas producing well having a plunger, a plunger arrival sensor and a valve between the well and an outlet line, the controller comprising:

at least one processing unit;

an input interface operatively connectable to the plunger arrival sensor;

an output interface operatively connectable to the valve and operative to open a close the valve;

at least one memory containing program instructions, the at least one processing unit responsive to the program instructions and operative to perform a method comprising:

opening the valve and allowing the plunger to rise to a top of the well;

in response to receiving a signal from the plunger arrival sensor, closing the valve and determining an actual rise time of the plunger based on a time it take the plunger to rise to the top of the well;

using a current afterflow time and a difference between a target rise time and the actual rise time to calculate an adjusted afterflow time;

after the adjusted afterflow time has passed, closing the valve and keeping the valve closed for a close time; and repeating the steps of the method, each time calculating a new adjusted afterflow time and keeping the control valve open for the new adjusted afterflow time, wherein the adjusted afterflow time is calculated using the function:

$$\Delta AfterflowTime = \frac{TargetRise - ActualRise}{TargetRise} \times ScalingFactor \times AfterflowTime$$

and $$AdjustedAfterflowTime = CurrentAfterflowTime + \Delta AfterflowTime$$

and wherein

ΔAfterflowTime is the change to be made to the afterflow time,

TargetRise is the target rise time of the plunger to the top of the well,

ActualRise is the time measured for the plunger to reach the top of the well,

ScalingFactor is a range between 0-1, and

AfterflowTime is the current afterflow time.

6. The controller of claim 5 wherein the change made to the current afterflow time to calculate the adjusted afterflow time is a function of the current afterflow time.

7. The controller of claim 6 wherein the greater the current afterflow time, the greater the difference between the current afterflow time and the adjusted afterflow time.

8. The controller of claim 5 wherein the Scaling Factor is less than 1.

9. A method of operating a plunger lift system in a fluid producing well, the method comprising:

opening a control valve and allowing a plunger to rise to a top of the well;

determining an actual rise time of the plunger based on a time it takes the plunger to rise to the top of the well;

using the current close time and a difference between a target rise time and the actual rise time to calculate an adjusted close time;

allowing the a period of time to pass before closing the control valve and keeping the valve closed for the adjusted close time;

and repeating the steps of the method, each time calculating a new adjusted close time and using the new adjusted close time in the method, wherein the adjusted close time is calculated using the function:

$$\Delta CloseTime = \frac{TargetRise - ActualRise}{TargetRise} \times ScalingFactor \times CloseTime$$

and $$AdjustedCloseTime = CurrentCloseTime - \Delta CloseTime$$

and wherein

ΔCloseTime is the change to be made to the close time,

TargetRise is the target rise time of the plunger to the top of the well,

ActualRise is the time measured for the plunger to reach the top of the well,

ScalingFactor is a range between 0-1, and

CloseTime is the current close time.

10. The method of claim 9 wherein the change made to the current close time to calculate the adjusted close time is a function of the current close time.

11. The method of claim 10 wherein the greater the current close time, the greater the difference between the current close time and the adjusted close time.

12. The method of claim 9 wherein the Scaling Factor is less than 1.

13. A controller for controlling the operation of a plunger lift system for a fluid producing well having a plunger, a plunger arrival sensor and a valve between the well and an outlet line, the controller comprising:

at least one processing unit;

an input interface operatively connectable to the plunger arrival sensor;

an output interface operatively connectable to the valve and operative to open a close the valve;

at least one memory containing program instructions, the at least one processing unit responsive to the program instructions and operative to perform a method comprising:

opening the valve and allowing the plunger to rise to a top of the well;

in response to receiving a signal from the plunger arrival sensor, closing the valve and determining an actual rise time of the plunger based on a time it takes the plunger to rise to the top of the well;

using the current close time and a difference between a target rise time and the actual rise time to calculate an adjusted close time;

after a period of time has passed, closing the valve and keeping the valve closed for the adjusted close time; and repeating the steps of the method, each time calculating a new adjusted close time and using the new adjusted close time, wherein the adjusted close time is calculated using the function:

$$\Delta CloseTime = \frac{TargetRise - ActualRise}{TargetRise} \times ScalingFactor \times CloseTime$$

and $$AdjustedCloseTime = CurrentCloseTime - \Delta CloseTime$$

and wherein

ΔCloseTime is the change to be made to the close time,

TargetRise is the target rise time of the plunger to the top of the well,

ActualRise is the time measured for the plunger to reach the top of the well,

ScalingFactor is a range between 0-1, and

CloseTime is the current close time.

14. The controller of claim 13 wherein the change made to the current close time to calculate the adjusted close time is a function of the current close time.

15. The controller of claim 14 wherein the greater the current close time, the greater the difference between the current close time and the adjusted close time.

16. The method of controller 13 wherein the Scaling Factor is less than 1.

17. A method of operating a plunger lift system in a gas producing well, the method comprising:

i. opening a control valve and allowing a plunger to rise to a top of the well;

ii. determining an actual rise time of the plunger based on a time it takes the plunger to rise to the top of the well;

iii. using a current close time and a difference between a target rise time and the actual rise time to calculate an adjusted close time;

iv. allowing a current afterflow time to pass before closing the control valve and keeping the valve closed for the adjusted close time;

v. while the adjusted close time is greater than a minimum limit and less than a maximum limit, repeating the steps i-iv, each time calculating a new adjusted close time and using the new adjusted close time in the method; and vi. after the adjusted close time reaches one of the minimum limit and the maximum limit, using the current afterflow time and a difference between a target rise time and the actual rise time to calculate an adjusted afterflow time;

vii. allowing the adjusted afterflow time to pass before closing the control valve and keeping the valve closed for the adjusted close time;

viii. opening a control valve and allowing a plunger to rise to a top of the well;

ix. determining an actual rise time of the plunger based on a time it takes the plunger to rise to the top of the well; and x. repeating steps vi-ix, each time calculating a new adjusted afterflow time and using the new adjusted afterflow time in step vii.

18. The method of claim 17 wherein the change made to the current close time to calculate the adjusted close time is a function of the current close time, and wherein the change made to the current afterflow time to calculate the adjusted afterflow time is a function of the current afterflow time.

19. The method of claim 18 wherein the greater the current afterflow time, the greater the difference between the current afterflow time and the adjusted afterflow time.

20. The method of claim 17 wherein the adjusted close time is calculated using the function:

$$\Delta AfterflowTime = \frac{TargetRise - ActualRise}{TargetRise} \times ScalingFactor \times AfterflowTime$$

and $$\text{AdjustedCloseTime} = \text{CurrentCloseTime} - \Delta\text{CloseTime}$$

and wherein

ΔCloseTime is the change to be made to the close time,

TargetRise is the target rise time of the plunger to the top of the well,

ActualRise is the time measured for the plunger to reach the top of the well,

ScalingFactor is a range between 0-1, and

CloseTime is the current close time, and wherein the adjusted afterflow time is calculated using the function:

$$\Delta AfterflowTime = \frac{TargetRise - ActualRise}{TargetRise} \times ScalingFactor \times AfterflowTime$$

and $$\text{AdjustedAfterflowTime} = \text{CurrentAfterflowTime} + \Delta\text{AfterflowTime}$$

and wherein

ΔAfterflowTime is the change to be made to the afterflow time,

TargetRise is the target rise time of the plunger to the top of the well,

ActualRise is the time measured for the plunger to reach the top of the well,

ScalingFactor is a range between 0-1, and

AfterflowTime is the current afterflow time.

21. The method of claim 20 wherein the Scaling Factor is less than 1.

* * * * *